US006418847B1

(12) United States Patent
Holecek

(10) Patent No.: US 6,418,847 B1
(45) **Date of Patent: *Jul. 16, 2002**

(54) PRINTING MACHINE WITH PLATE THICKNESS COMPENSATION

(75) Inventor: Michael G. Holecek, Sparks, MD (US)

(73) Assignee: Ward Holding Company, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/421,568

(22) Filed: Oct. 20, 1999

(51) Int. Cl.[7] ..... B41F 13/24
(52) U.S. Cl. ..... 101/232; 271/12; 271/35

(58) Field of Search ..... 101/217, 232, 101/216, 240; 271/11, 12, 34, 35

(56) References Cited

U.S. PATENT DOCUMENTS

| | | | | | |
|---|---|---|---|---|---|
| 4,438,694 | A | * | 3/1984 | Parkins et al. | 101/152 |
| 4,867,433 | A | | 9/1989 | Wells et al. | 271/35 |
| 5,074,539 | A | | 12/1991 | Wells et al. | 271/12 |
| 5,385,091 | A | * | 1/1995 | Cuir et al. | 101/217 |

* cited by examiner

*Primary Examiner*—Ren Yan
(74) *Attorney, Agent, or Firm*—Ronald B. Sherer; Bartlett & Sherer

(57) ABSTRACT

A rotary printing machine is disclosed in which the timing of the sheet feeding is adjustable as a function of the thickness of the selected printing plate.

8 Claims, 2 Drawing Sheets

PRINTING MACHINE WITH PLATE THICKNESS COMPENSATION

FIELD

This invention relates to printing machines for printing on individual sheets with different printing plates of different thickness, and more particularly, to a printing machine having an adjustable feed mechanism for feeding the sheets with variable timing so as to compensate for printing plates of different thicknesses.

BACKGROUND

As shown by way of example in U.S. Pat. Nos. 4,867,433 and 5,074,539, it is known to successively feed individual sheets of material, such as corrugated cardboard, into the first stage of a printing machine by means of feed belts which engage each sheet and then accelerate each sheet toward the printing stage; said U.S. patents being hereby incorporated by reference. Such feeding systems perform an excellent function of feeding one or two sheets per machine cycle with excellent registry of each sheet with the print plate. This produces very high quality multiple-color images on sheets, such as sheets to become containers which are generally known as container blanks.

More recently, however, it has become possible and desirable to use print plates of much less thickness than the older print plates, and the thinner print plates have their own advantages. The problem is-that it is not economic to throw away the older, thicker print plates when they still have a significant wear-life left. As a result, the same printing cylinders are sometimes fitted with the older, thicker plates and sometimes fitted with the newer, thinner plates. This creates a serious problem in that the difference thicknesses of the plates increases or decreases the combined diameter of the cylinder and associated plate. This means that the critical registry of the sheet and the rotary position of the print cylinder is changed depending upon whether the print cylinder is fitted with a relatively thick or thin printing plate, and this decreases the quality of the multi-color image which is printed.

SUMMARY

The present invention solves this serious problem by varying the feed timing so that each sheet is delivered to the rotary print cylinder at precisely the correct instant so as to correct or compensate for variations in the thickness of the print plate.

DETAILED DESCRIPTION

Figure 1:
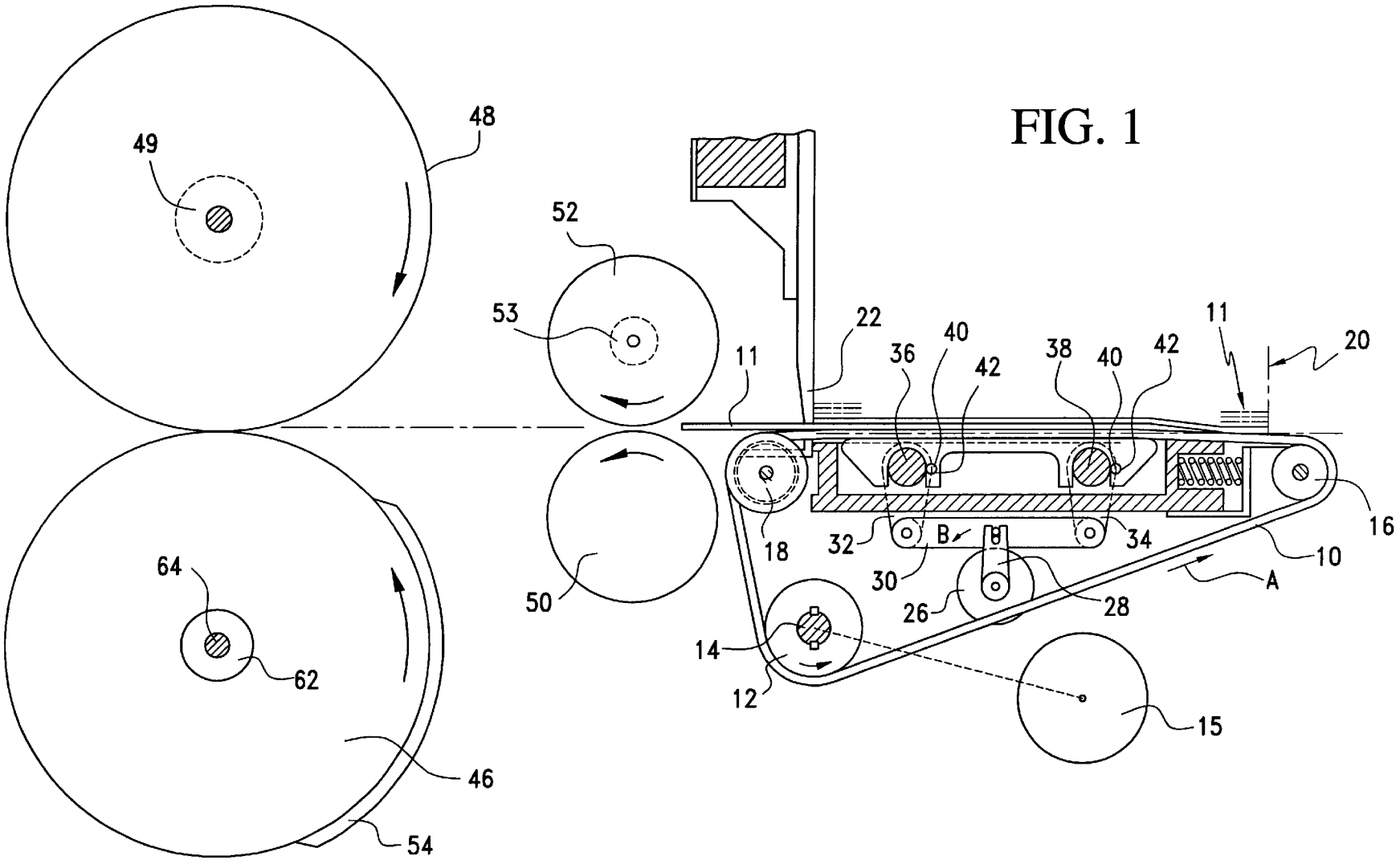
FIG. 1 is a schematic side elevational view, partly in cross-section, of a modification of a known feed mechanism as more fully described in U.S. Pat. No. 5,074,539.

Referring to FIG. 1, a plurality of laterally spaced apart feed belts 10 are driven in the direction of arrow A by drive pulleys 12 driven by a drive shaft 14 by a servo motor 15 with the belts extending around idler pulleys 16, 18 as shown. The upper reaches of belts 10 are positioned immediately below a stack of sheets 11 to be printed. Sheets 11 are preferably contained in a hopper 20 having a gate 22. Each of belts 10 passes over the upper surface of a lifter bar 24 such that, when bars 24 are in their lifted or raised positions, the upper reaches of belts 10 engage the bottom surface of the lowermost sheet in the stack. Conversely, when lifter bars 24 are in their lowered positions, belts 10 are not in engagement with a sheet. The raising and lowering of lifter bars 24 may be effected in various known ways. By way of one example, a servo motor 26 may be employed to oscillate a pivoted arm 28 which moves a link 30 horizontally to the right and left as viewed in FIG. 1.

Link 30 is connected to a pair of vertical links 32, 34 which are connected at their upper ends to laterally extending oscillation shafts 36, 38. Each of oscillation shafts 36, 38 includes a horizontally extending key 40, and keys 40 are engaged in grooves 42 in lifter bars 24. Accordingly, pivoted movement of arm 28 in the direction of the arrow B moves the lower ends of links 30 to the left and pivots vertical links clockwise about the axes of shafts 36, 38. This motion lowers lifter bars to their lower position in which they do not engage the lowermost sheet in the stack. Conversely, pivoted movement of arm 28 in the opposite direction, as driven by servo motor 26, causes lifter bars 24 to be raised into engagement with the lowermost sheet.

Preferably, feed belts 10 do not run continuously, but rather, they are accelerated by servo motor 15 only after feed belts 10 have been raised into engagement with the lowermost sheet in the stack. The lowermost sheet is thereby accelerated to the left as viewed in FIG. 1 toward the nip between printing cylinder 46 and impression cylinder 48. As illustrated by way of example, printing cylinder 46 prints the Image on the bottom surface of each sheet. However, it will understood that the relative positions of cylinders 46 and 48 may be reversed so as to print the image on the upper surface of the sheets as is known in the art.

In the embodiment as illustrated in FIG. 1, a pair of feed rollers 50, 52 are positioned between feed belts 10 and print cylinder 46 such that the feed belts 10 accelerate the sheets into the feed rollers which, in turn, feed the sheets Unto the nip between cylinders 46 and 48. In other embodiments, as also disclosed in U.S. Pat. No. 5,074,539, which is hereby incorporated by reference, the feed rollers may be replaced by short vacuum conveyors. Alternatively, under appropriate conditions, the sheets may be fed directly into the nip between cylinders 46 and 48 by the feed belts 10. In either event, feed belts 10 determine the timing of sheets 11 being fed into the nip between cylinders 46 and 48.

FIG. 1 shows a print plate 54 attached to print cylinder 46 by one or other of several attachment means well-known in the rotary printing art. Of course, it will understood that the thickness of plate 54 is greatly exaggerated relative to the diameter of print cylinder 46 for purposes of clarity. For example, one typical diameter of a print cylinder may be in the order of 20 or more inches, whereas the range of thicknesses of relatively thinner and thicker print plates may be in the order of 0.065 to 0.280 inches, respectively. In this regard, it may appear at first glance that the change in the diameter of the combined print cylinder and plate, as between thick and thin plates, is so small as to be of little consequence. However, it must be realized that, for perfectly clear and high quality multi-color printing, this difference in plate thickness, and the resultant change in the diameter of the print cylinder, is sufficient to cause undesirable and/or unacceptable blurring of the colors in the multi-colored printed image.

Figure 2:
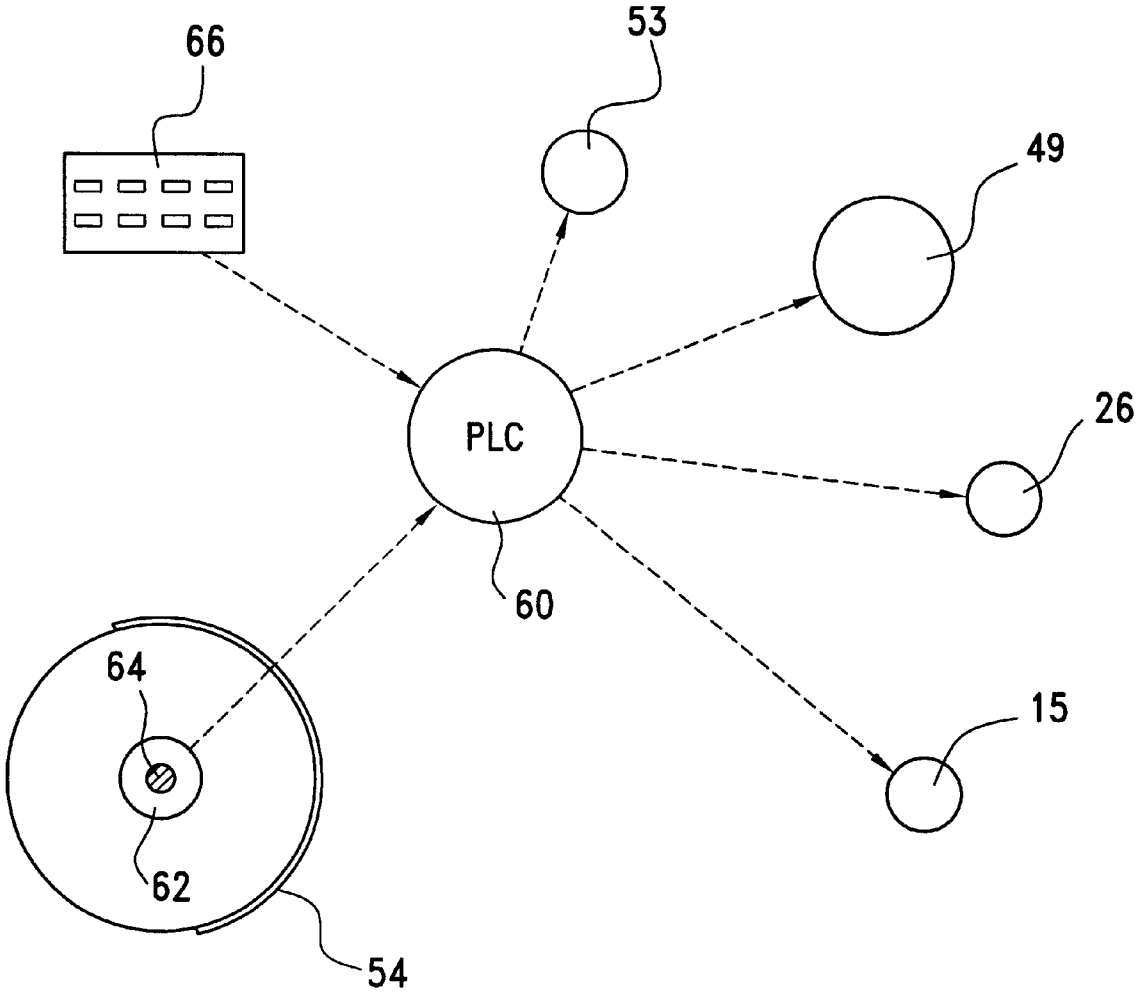
FIG. 2 is a schematic block diagram illustrating the computer controlled system for varying the feed timing.

Referring to FIG. 2, the present invention utilizes a Programmable Logic Controller (PLC) 60. PLC 60 may be automatically, or manually inputted such as, for example, through a keyboard 66,. or by other known electronic inputting devices. In either event, data defining the thickness of the particular print plate to be used in the next run of sheets through the printing machine is inputted to PLC 6C. This data determines the precise diameter and circumference of print cylinder. .46 with that particular printing plate being attached, and the PLC calculates the precise rotational surface speed of the particular print plate. PLC 60 is also continuously inputted with speed and position signals from an encoder 62 which is driven by shaft 64 driving the printing cylinder. This signal inputs the exact rotational position of the print cylinder and the print plate to the PLC at all times. With these inputs, PLC 60 calculates the precise time at which each sheet 11 should be accelerated by feed belts 10 so as to arrive at the nip sufficiently earlier or later depending upon the actual thickness of the print plate then in use.

As a result of these inputs, the PLC sends output signals to servo motor 26 and servo motor 15 so that feed belts 10 engage the lowermost sheet, and accelerate it precisely so as to arrive at the nip of the print and impression cylinders at the optimum time required as a function of the thickness of the print plate being used at that time. PLC 60 also sends signals to motor(s) 53 driving feed rollers 50, 52 and to the drive system 49 driving impression cylinder 48 so that feed rollers 50, 52 and impression cylinder 48 are all driven at precisely the same rotary surface speed as that of the surface speed of printing plate 54. Alternatively, if a feed conveyor is used instead of feed rolls, PLC 60 sends a signal to the motor driving such feed conveyor so as to convey each sheet at the linear velocity which corresponds to the surface speed of the print plate with the particular thickness as inputted to PLC 60. Thus, all components are in perfect synchronization and thereby produce a clear multi-color image on the sheet as long as a plate of the same thickness is attached to the printing cylinder.

When a given run of sheets is completed with a given print plate, and a print plate of a different thickness is installed on the print cylinder, the thickness of the new print plate is inputted into PLC 60. The PLC then calculates the new optimum. timing of the sheet feeding, and controls servo motors 26 and 15, and adjusts the surface speed of impression cylinder 48 and feed rolls 50, 52 so as to effect the precise time of arrival of each sheet at the nip of cylinders 46, 48 and synchronize the rotating components to the new surface speed for the new thickness of the printing plate.

In the above manner, older and generally thicker print plates may continue to be used, along with newer and generally thinner plates, while at the same time, producing clear, non-blurred and excellent quality images regardless of the varying thickness of the print plates being used at any given time.

In the foregoing description of one preferred embodiment of the invention, the drive for impression cylinder 48 has been referred to generically as a "drive system". This term is intended to include well known and conventional drive systems which comprise a single motor and a multi-stage gear train, as well as drive systems which comprise two or more individual motors directly connected to drive two or more of the rotary components as disclosed for example in U.S. Pat. No. 5,383,392, which is also incorporated herein by reference.

Lastly, it will be readily understood that the foregoing description of one preferred embodiment of the invention is intended to be illustrative of the principles of the invention, and is not intended in any way to be exhaustive of the many variations of the invention which will become apparent to those skilled in the art of rotary printing. Therefore, it is intended that the foregoing description is purely illustrative of the invention, and that the legal scope of the invention is intended to be defined solely by the claims as interpreted under the doctrine of equivalents.

What is claimed is:

1. A rotary printing machine comprising:

(a) a printing cylinder;

(b) a printing plate of predetermined thickness mounted on said printing cylinder;

(c) a feeder for feeding a plurality of individual sheets of material from a stack to said printing cylinder;

(d) said feeder including at least one feed belt means for successively engaging the lowermost sheet of said stack and accelerating the sheet toward said printing cylinder; and (e) controller means for controlling the timing of said successive engagements of said belt with the lowermost sheet as a function of the thickness of said printing plate.

2. The rotary printing machine of claim 1 including a pair of feed rollers and feed roller drive means, and wherein said controller means are connected to said feed roller drive means for synchronizing the surface speed of said feed rollers with said printing cylinder as a function of the thickness of said printing plate.

3. The rotary printing machine of claim 1 wherein said controller means comprise a Programmable Logic Controller (PLC), and said input means comprise electronic means for inputting the thickness of the printing plate into said PLC.

4. The rotary printing machine of claim 1 including encoder means attached to said printing cylinder for producing a signal indicative of the instantaneous rotary position of said printing cylinder, and output means connected between said encoder means and said controller means for inputting said signal to said controller means.

5. A feed system for a rotary printing machine including a printing cylinder carrying a printing plate of a given thickness comprising:

(a) hopper means for containing a stack of individual sheets of material to be imprinted;

(b) feed means for ejecting said individual sheets sequentially from said hopper means toward said printing cylinder; and (c) control means for adjusting the timing of said ejection feed means as a function of said given thickness of said printing plate.

6. The feed system of claim 5 including additional feed means for feeding said sheets from said ejection feed means to said printing cylinder, and variable speed motor means for driving said additional means at a speed controlled by said control means as a function of said given thickness of said printing plate, and wherein said additional feed means comprise a pair of feed rollers.

7. A rotary printing machine for printing on successive sheets and compensating for the different thicknesses of a plurality of print plates, comprising;

(a) a rotary print cylinder for rotating a print plate of a given thickness;

(b) control means;

(c) inputting means for inputting the thickness of said print plate into said control means;

(d) feed means for ejecting successive sheets from a stack and accelerating them toward said print cylinder; and (e) output means connected to said control means and to said feed means for timing the ejection of sheets as a function of the thickness of said print plate.

8. The rotary printing machine of claim 7 including a pair of feed rollers located between said feed means and said print cylinder, and means connected to said control means and to feed rollers for operating said feed rollers as a function of the thickness of said print plate.

* * * * *